United States Patent [19]

Nguyen-Thanh

[11] Patent Number: 4,505,329

[45] Date of Patent: Mar. 19, 1985

[54] HEAT EXCHANGER

[75] Inventor: Thong Nguyen-Thanh, Cernay-la-Ville, France

[73] Assignees: Commissariat a l'Energie Atomique, Paris; Stein Industrie, Velizy Villacoublay, both of France

[21] Appl. No.: 337,759

[22] Filed: Jan. 7, 1982

[30] Foreign Application Priority Data

Jan. 13, 1981 [FR] France ..... 81 00455

[51] Int. Cl.[3] ..... F28F 7/00

[52] U.S. Cl. ..... 165/81; 165/159

[58] Field of Search ..... 165/81, 159, 160, 134

[56] References Cited

FOREIGN PATENT DOCUMENTS 0004218 9/1979 European Pat. Off. .
2644303 4/1977 Fed. Rep. of Germany .
1006491 12/1952 France .
2171869 9/1973 France .
2172799 10/1973 France .
2139076 12/1973 France .
2218528 9/1974 France .
2293684 7/1976 France .
2303257 10/1976 France .
2327507 9/1977 France .
2415262 8/1979 France .

*Primary Examiner*—William R. Cline
*Assistant Examiner*—John F. McNally
*Attorney, Agent, or Firm*—Oblon, Fisher, Spivak, McClelland & Maier

[57] ABSTRACT

Heat exchange device with a group of tubes and expansion bends which are not subject to vibration.

The device has a group of tubes arranged between two tube plates and provided with expansion bends, for heat exchange between a fluid circulating within the tubes and a liquid circulating around the tubes.

Expansion bends are arranged in contact with the liquid in the coldest zone of the exchanger. The device comprises means for ensuring that the liquid cannot cause any vibration of the expansion bends.

Application to heat exchangers for a steam generator in which the primary fluid is constituted by liquid sodium.

11 Claims, 6 Drawing Figures

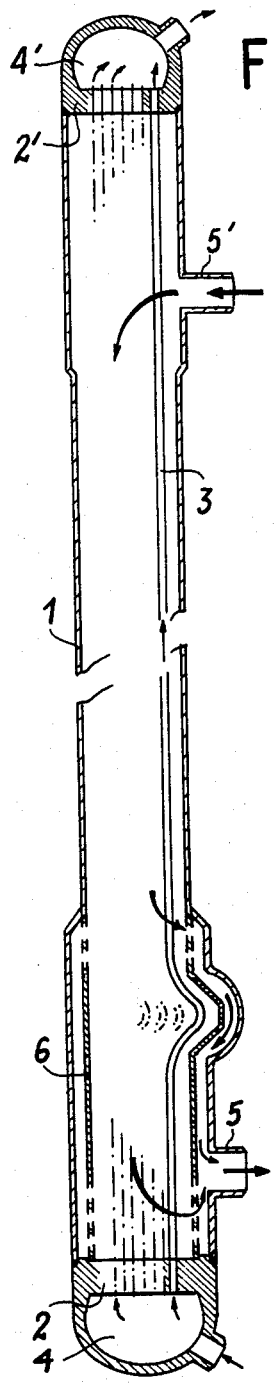
FIG.1
FIG.6
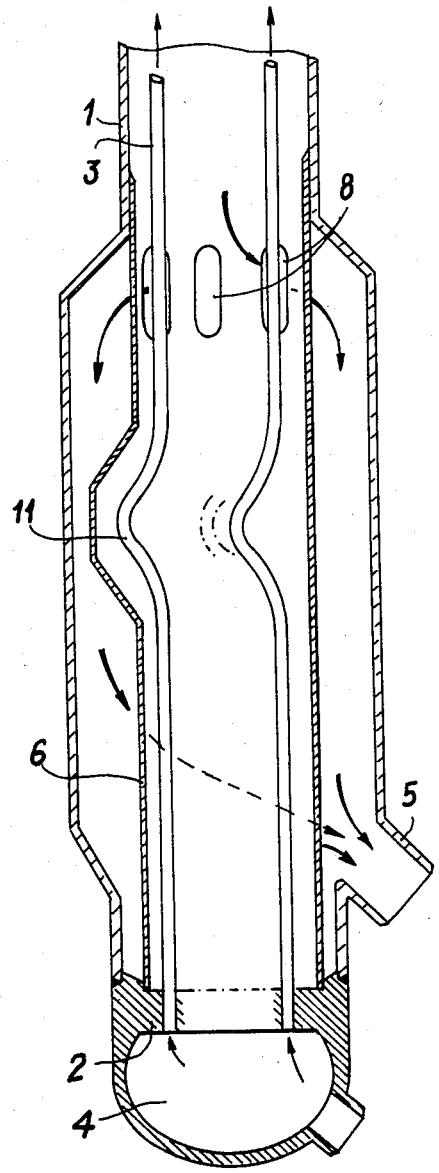

1
8
X
IV
IV
12
11
5
6
7
3
9
13A
2
10

HEAT EXCHANGER

BACKGROUND OF THE INVENTION

The present invention relates to a device having a group of tubes arranged between two tube plates and provided with expansion bends for heat exchange between a fluid circulating within the tubes and a liquid circulating around the tubes.

The expansion bends of such devices can be caused to vibrate for certain flow rates of the fluid circulating around the tubes, particularly when this fluid is a liquid alkali metal. If the excitation frequency due to the fluid flow is close to the resonant frequency of the expansion bends, the vibrations which occur can be sufficient to seriously damage the tubes.

For obviating this phenomenon it has already been proposed to place the expansion bends in an area where they are not in contact with the flowing fluids, for example when the latter is a liquid alkali metal, in a zone filled with a rare gas surmounting the bath of said metal, in the vicinity of the tube plate of the hot end of the exchanger.

However, this often leads to an increase in the length of the group of tubes, which is often already very long, the length of the expansion bends not being involved in the heat exchange. Moreover, the expansion bends are located in the hottest part of the exchanger, where the permitted work rate is lowest.

BRIEF SUMMARY OF THE INVENTION

The problem of the present invention is to obviate the aforementioned disadvantages and to provide a device not having a special area reserved for the expansion bends and not participating in the heat exchange. It also aims at ensuring the operation of the expansion bends with a more favourable work rate outside the hottest area of the exchanger, thereby making it possible to use thinner tubes.

According to the invention this problem is solved by a heat exchanger device comprising an outer ferrule closed at its ends by two tube plates, a group of tubes provided with expansion bends, said tubes being connected to the tube plates to issue into inlet and outlet collectors for a fluid circulating within the tubes and inlet and outlet pipes for a liquid circulating in the ferrule and around the tubes, wherein the expansion bends are positioned in contact with the liquid in the coldest area of the exchanger, and wherein means are provided for deflecting at least part of the liquid flow at the expansion bends, in order that the said liquid cannot cause the latter to vibrate.

According to another feature of the invention the means for deflecting at least part of the liquid flow comprise a jacket located within the outer ferrule and in which are placed the expansion bends and at least one orifice made in ferrule upstream of the expansion bends in order to deflect at least part of the liquid flow between the inner jacket and the outer ferrule.

The invention is also characterized by at least one of the following features:

the expansion bends are in contact with the flowing liquid, said means also comprising at least one second orifice provided in the ferrule downstream of the expansion bends, at least one of the orifices having means for the distribution of the flow between the inside and outside of the jacket, such that the metal is in contact with the expansion bends at a speed which is sufficiently low that it does not vibrate the latter;

the expansion bends are in contact with a static liquid bath, said jacket being sealed downstream of the expansion bends in such a way that all the metal is deflected between the inner jacket and the outer ferrule;

the expansion bends are balanced with respect to the general axis of the tubes, so that they do not exert any bending stress on their connection to the tube plates;

the expansion bends are symmetrical to the axis of the tubes;

stabilization bars are arranged between the expansion bends in planes parallel to the planes of the latter.

BRIEF DESCRIPTION OF THE DRAWINGS

The invention is described in greater detail hereinafter relative to two non-limitative embodiments and with reference to the attached drawings, wherein show:

FIG. 1 a diagrammatic sectional view of a steam generator constructed according to the invention.

FIG. 6 a view of the lower part of the steam generator comparable to FIG. 2, showing a variant of the invention in which the expansion bends of the tubes are in contact with a static liquid bath.

DETAILED DESCRIPTION OF THE PREFERRED EMBODIMENTS

Figure 2:
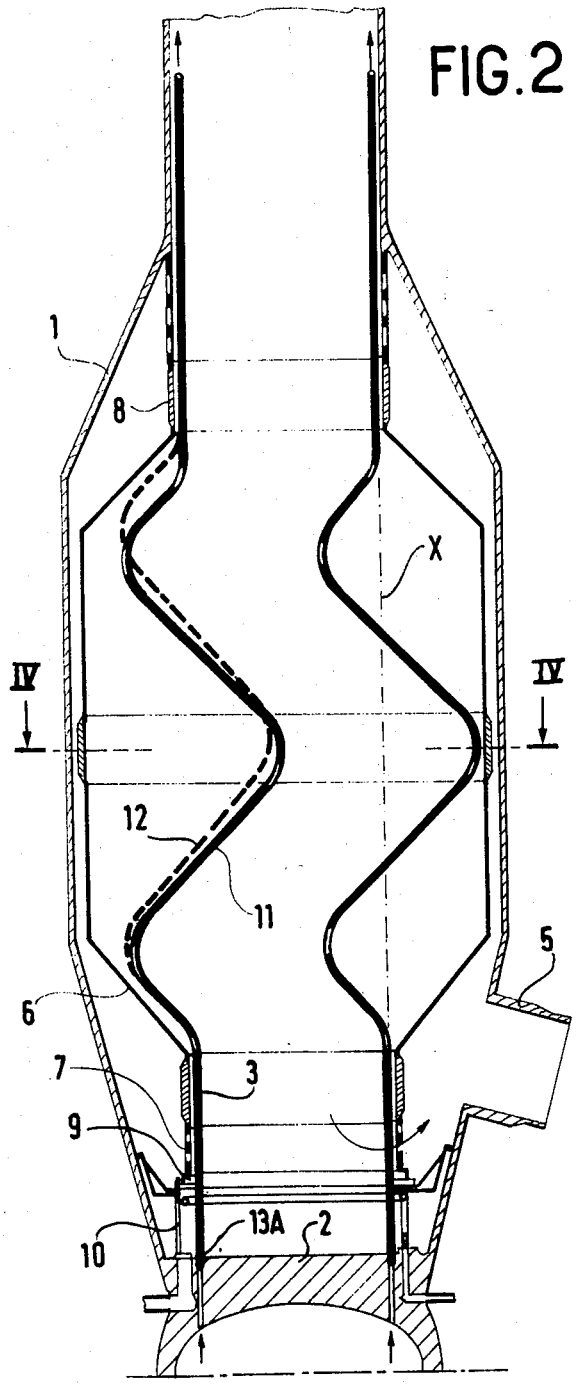
FIG. 2 a larger scale sectional view showing the lower part of the steam generator of FIG. 1 and illustrating a first constructional variant according to which the expansion bends of the tubes are in contact with the flowing liquid.

FIG. 1 shows that the steam generator comprises a vertically extending outer ferrule 1 closed at its upper and lower ends by tube plates 2, 2' to which are connected the tubes such as 3 of a group of tubes positioned inside ferrule 1. These tubes issue respectively in the lower part of the steam generator, in an inlet collector 4 for the water of the secondary circuit of the generator and in its upper part in an outlet collector 4' for the vapourized water. Thus, the water to be vapourized circulates from bottom to top within tubes 3 between collectors 4 and 4'.

The liquid metal (generally sodium) circulating in the primary circuit of the generator travels in counterflow relative to the water of the primary circuit, i.e. from bottom to top, within ferrule 1 and around tubes 3 between an inlet pipe 5' and an outlet pipe 5.

As is more particularly illustrated in FIG. 2, the tubes 3 are generally rectilinear, each of them defining a vertical axis X. However, in each case they have in the vicinity of their lower end connected to tube plate 2, an expansion bend represented at 11 in its cold position and at 12 in its hot position. Thus, the expansion bends are located in the coldest area of the exchanger, i.e. in contact with the liquid sodium, cooled in contact with the water to be vapourized. Moreover, the expansion bends are balanced, i.e. the length of their branches and their position with respect to the axes X of the tubes are such that, in operation, the bends exert no bending stress on the nipples 13A joining the tubes to the tube plate 2.

According to the invention the expansion bends 11 are positioned within a thin jacket 6 defining with the outer ferrule 1 an annular passage deflecting at least part of the liquid sodium flow flowing between inlet ferrule 5' and outlet ferrule 5. To this end the thin jacket 6 is provided, above expansion bends 11, with an annular orifice 8 by which at least part of the liquid sodium descending in the outer ferrule 1 is deflected into the annular passage formed between said ferrule and jacket 6.

In the constructional variant of FIG. 2, ferrule 6 is extended below the expansion bends by a perforated ferrule 7 welded to the ferrule 6 and by which that part of the liquid sodium descending within ferrule 6 passes into the annular passage again and is discharged by pipe 5 together with that part of the sodium which has been deflected into said passage by orifice 8. Perforated ferrule 7 ensures the desired distribution of the liquid sodium flow between the inner and outer areas of jacket 6. More specifically the passage cross-section of the holes of perforated ferrule 7 defines a sufficiently large pressure drop, relative to the passage cross-section about jacket 6, for the hot liquid sodium flow rate within the jacket to be sufficiently low that there is no risk of it vibrating the expansion bends.

As is shown in FIG. 2, the perforated ferrule 7 is fixed to a circular ring 9, itself connected to tube plate 2 by bolts 10.

Figure 3:
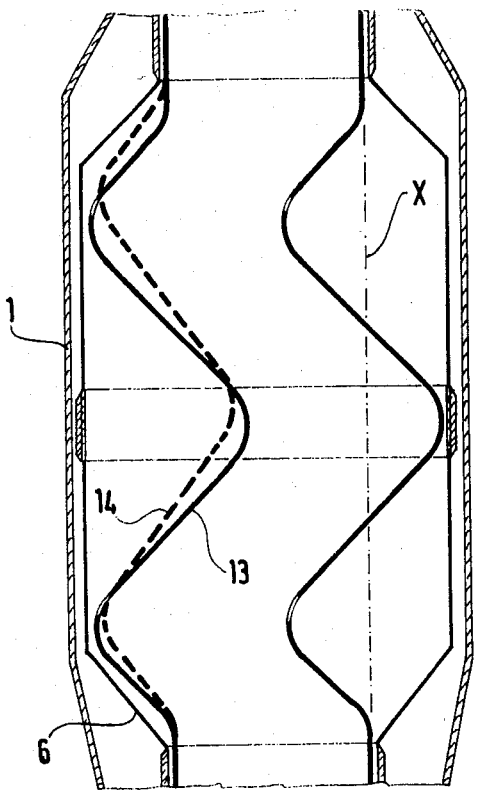
FIG. 3 a diagrammatic view comparable to FIG. 2 showing a variant in which the expansion bends of the tubes are symmetrical.

FIG. 3 shows a variant of the steam generator of FIG. 2 in which the expansion bends, such as 13, are symmetrical to the general axis X of the corresponding tube (the position of the hot bend is shown at 14). This has the advantage of reducing the overall transverse dimension of the bends and consequently the diameter of ferrule 6. Conversely the length of the bends is increased and, in operation, they exert a certain bending stress on the nipples for joining the tube to the not shown tube plate.

Figure 4:
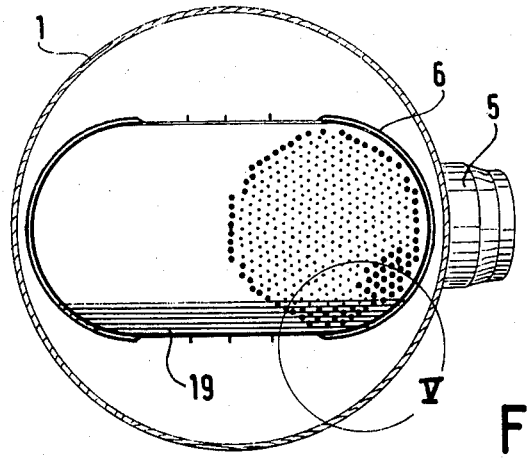
FIG. 4 a sectional view along line IV—IV of FIG. 2.
Figure 5:
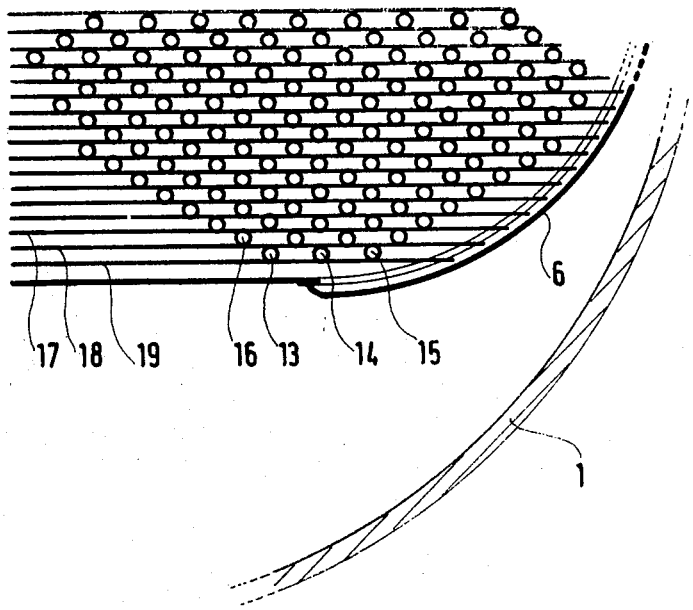
FIG. 5 a larger scale view of detail V of FIG. 4.

FIG. 4 is a sectional view along axis IV—IV of FIG. 2 and FIG. 5 is a detail V of FIG. 4. These drawings make it possible to see the staggered distribution of the tubes such as 13, 14, 15, 16 and the bars 17, 18, 19 slid between the rows of tubes in order to further protect them against vibrations.

Finally FIG. 6 shows a variant of FIG. 2 in which the area within ferrule 6 containing the expansion bends 11 contains liquid sodium in the static state instead of flowing sodium. To this end perforated ferrule 7 is eliminated and ferrule 6 is directly connected to tube plate 2. Thus, and as is illustrated by the arrows in FIG. 6, all the liquid sodium flow takes place through orifices 8 outside ferrule 6.

In this configuration, the expansion bends still participate in the heat exchange, but they are in contact with the static liquid sodium, in such a way that there is no risk of the bends vibrating.

Although the devices described hereinbefore with reference to the drawings would appear to be the preferred embodiments of the invention, it is readily apparent that serious modifications can be made thereto without passsing beyond the scope of the invention and that certain of the components thereof can be replaced by technical equivalents. In particular, in the constructional variant of FIG. 2, the members for distributing the flow between the inner and outer areas with respect to the envelope need not be in the form of a grating with calibrated holes. They may also be positioned upstream of the inner envelope and not downstream thereof.

The invention is applicable to heat exchangers having groups of tubes and expansion bends, more particularly for a steam generator where the primary fluid is constituted by a liquid alkali metal.

What is claimed as new and desired to be secured by Letters Patent of the United States is:

1. A heat exchanger device comprising an outer ferrule closed at its ends by two tube plates, a group of tubes provided with expansion bends, said tubes being connected to the tube plates to issue into inlet and outlet collectors for a fluid circulating within the tubes and inlet and outlet pipes for a liquid circulating in the ferrule and around the tubes, wherein the expansion bends are positioned in contact with the liquid in the coldest area of the exchanger, and wherein means are provided for deflecting at least part of the liquid flow at the expansion bends, in order that said liquid cannot cause the latter to vibrate, wherein the means for deflecting at least part of the liquid flow comprise a jacket located within the outer ferrule and in which are placed the expansion bends and at least one orifice made in said jacket upstream of the expansion bends in order to deflect at least part of the liquid flow between the inner jacket and the outer ferrule.

2. A device according to claim 1, wherein the expansion bends are in contact with the flowing liquid, said means also comprising at least one second orifice provided in the jacket downstream of the expansion bends, at least one of the orifices having means for the distribution of the flow between the inside and the outside of the jacket, such that the metal is in contact with the expansion bends at a speed which is sufficiently low that it does not vibrate the latter.

3. A device according to claim 1, wherein the expansion bends are in contact with a static liquid bath, said jacket being sealed downstream of the expansion bends in such a way that all the metal is deflected between the inner jacket and the outer ferrule.

4. A device according to claim 1, wherein the expansion bends are balanced with respect to the general axis of the tubes, so that they do not exert any bending stress on their connection to the tube plates.

5. A device according to claim 1, wherein the expansion bends are symmetrical to the axis of the tubes.

6. A device according to claim 1, wherein stabilization bars are arranged between the expansion bends in planes parallel to the planes of the latter.

7. A heat exchanger device comprising an outer ferrule closed at its ends by two tube plates, a group of tubes provided with expansion bends, said tubes being connected to the tube plates to issue into inlet and outlet collectors for a fluid circulating within the tubes and inlet and outlet pipes for a liquid circulating in the ferrule and around the tubes, wherein the expansion bends are positioned in contact with the liquid in the coldest area of the exchanger, and wherein means are provided for deflecting at least part of the liquid flow at the expansion bends, in order that said liquid cannot cause the latter to vibrate, wherein stabilization bars are arranged between the expansion bends in planes parallel to the planes of the latter wherein the means for deflecting at least part of the liquid flow comprise a jacket located within the outer ferrule and in which are placed the expansion bends and at least one orifice made in said jacket upstream of the expansion bends in order to deflect at least part of the liquid flow between the inner jacket and the outer ferrule.

8. A device according to claim 7, wherein the expansion bends are in contact with the flowing liquid, said means also comprising at least one second orifice provided in the jacket downstream of the expansion bends, at least one of the orifices having means for the distribution of the flow between the inside and the outside of the jacket, such that the metal is in contact with the expansion bends at a speed which is sufficiently low that it does not vibrate the latter.

9. A device according to claim 7, wherein the expansion bends are in contact with a static liquid bath, said jacket being sealed downstream of the expansion bends in such a way that all the metal is deflected between the inner jacket and the outer ferrule.

10. A device according to claim 7, wherein the expansion bends are balanced with respect to the general axis of the tubes, so that they do not exert any bending stress on their connection to the tube plates.

11. A device according to claim 7, wherein the expansion bends are symmetrical to the axis of the tubes.

* * * * *